US006281167B1

(12) United States Patent
Takano et al.

(10) Patent No.: US 6,281,167 B1
(45) Date of Patent: Aug. 28, 2001

(54) THERMAL TRANSFER IMAGE-RECEIVING PAPER

(76) Inventors: Shunichi Takano; Kazuo Sato; Noriyoshi Umeta, all of 7-34 Yodabashicho, Fuji, Shizuoka (JP)

( * ) Notice: Subject to any disclaimer, the term of this patent is extended or adjusted under 35 U.S.C. 154(b) by 0 days.

(21) Appl. No.: 09/512,222

(22) Filed: Feb. 24, 2000

(30) Foreign Application Priority Data

Mar. 8, 1999 (JP) ..... 11-060692

(51) Int. Cl.[7] ..... B41M 5/035; B41M 5/38

(52) U.S. Cl. ..... 503/227; 428/211; 428/318.4; 428/319.3

(58) Field of Search ..... 428/195, 211, 428/318.4, 319.3, 913, 914; 503/227

(56) References Cited

FOREIGN PATENT DOCUMENTS 61-186471 * 11/1986 (JP) .
62-198497 * 9/1987 (JP) .
6-15975 * 1/1994 (JP) .
6-84119 * 10/1994 (JP) .

* cited by examiner

*Primary Examiner*—Bruce H. Hess
(74) *Attorney, Agent, or Firm*—Carter, Ledyard & Milburn

(57) ABSTRACT

An object of the invention is to provide a novel thermal transfer image-receiving paper comprising a layer of a fibrous paper having writing, typing and printing properties provided at low costs via a waterproof layer capable of preventing the curling caused by absorption and desorption of moisture by a base paper, on that side of the base paper on which an image-receiving layer is not provided. The thermal transfer image-receiving paper comprises a base paper 1 provided thereon with a foamed plastic film layer 2, said plastic film layer 2 being provided thereon with an image-receiving layer 3 while said base paper 1 being provided with a fibrous paper layer 4 via a waterproof layer 5 on the side on which the image-receiving layer 3 is not provided.

4 Claims, 1 Drawing Sheet

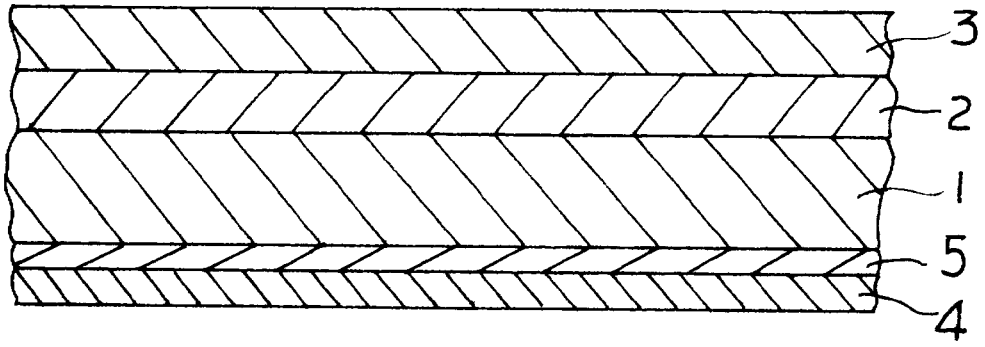
3
2
1
5
4

THERMAL TRANSFER IMAGE-RECEIVING PAPER

BACKGROUND OF THE INVENTION

1. Field of the Invention

The present invention relates to a thermal transfer image-receiving paper and in particular to a thermal transfer image-receiving paper comprising a fibrous paper layer having writing, typing and printing properties provided on the side of a base paper on which an image-receiving layer is not provided.

2. Description of the Related Art

Conventionally, a thermal transfer image-receiving paper provided with a foamed plastic film layer is well-known, and in such a thermal transfer image-receiving paper, transportability at the time of printing is improved and the thermal curling of the image-receiving paper is prevented by the rigidity of its base paper in addition to the cushioning properties and flatness of the foamed plastic film, and the curling of the image-receiving paper by the absorption and desorption of moisture by the base paper is further prevented by providing a waterproof layer or a resin layer on the face opposite to the side on which the image-receiving layer is provided, as disclosed in the following patent publications.

That is, Japanese Patent Application Publication No. 6-84119 discloses a heat-sensitive transfer image-receiving paper comprising a foamed plastic film laminated onto a base paper and the plastic film provided thereon with an ink absorption layer, which is provided with a waterproof layer on that side of the base paper on which the foamed plastic film is not laminated, thereby preventing curling which may occur on the whole of the paper by absorption and desorption of moisture when only one side of the base paper is provided with the foamed plastic film.

Further, Japanese Patent Application Laid-Open No. 6-15975 discloses a thermal transfer sheet wherein a base material is formed by laminating a core material for preventing curling onto one side of a porous plastic film, the base material is provided with a receiving layer on the side of the porous plastic film while the base material is provided with a resin layer playing a reinforcing role in preventing curling on the side on which the porous plastic film of the core material is not laminated.

Furthermore, Japanese Patent Application Laid-Open No. 62-198497 discloses a thermal transfer sheet wherein a base material prepared by laminating a core material for preventing curling onto one side of a synthetic paper is provided with a receiving layer on the side of the synthetic paper, while the base material is provided with a resin layer playing a reinforcing role in preventing curling on the side on which the synthetic paper of the core material is not laminated.

However, the waterproof layer or resin layer for preventing curling, which has been provided on that side of the base paper or base material on which the ink absorption layer or receiving layer is not provided in the conventional thermal transfer image-receiving papers described above, is a synthetic resin layer in a broad sense, and thus there is the problem that higher costs generally result when such layers are provided by coating such as air knife coating, roll coating and extrusion coating or by lamination such as dry lamination and extrusion lamination.

Further, the waterproof layer or the resin layer provided as described above, does not have writing properties or printing properties as possessed by fibrous papers, so there is the problem of additional costs because such layers require a special coating to endow them with typing, printing or writing properties possessed by fibrous papers for ink jet printing.

SUMMARY OF THE INVENTION

Accordingly, an object of the present invention is to solve the problems of the conventional thermal transfer image-receiving papers described above and to provide a novel thermal transfer image-receiving paper wherein a base paper is provided at low costs via a waterproof layer capable of preventing the curling caused by absorption and desorption of moisture by the base paper, with a layer of a fibrous paper having writing, typing and printing properties on that side of the base paper on which the image-receiving layer is not provided.

The constitution of the present invention made for the purpose of solving the problems described above is characterized in that the thermal transfer image-receiving paper comprises a base paper provided thereon with a foamed plastic film layer, the plastic film layer being provided thereon with an image-receiving layer while the base paper being provided with a fibrous paper layer via a waterproof layer on the side on which the image-receiving layer is not provided.

In the thermal transfer image-receiving paper of the invention constituted as described above, the fibrous paper layer can be provided by preparing a previously formed film as the base paper provided with a waterproof layer by extrusion lamination of a molten polymer or roll coating lamination of a resin and then laminating a fibrous paper thereon, or by laminating a fibrous paper previously provided with a waterproof layer in the method described above onto the side of the base paper on which the image-receiving layer is not provided. Further, when the base paper is provided, without using the previously formed film, directly with the fibrous paper layer by melt extrusion lamination, dry lamination, roll coating of a molten resin on the side on which the image-receiving layer is not provided, an adhesive layer at a joint portion between the base paper and the fibrous paper layer serves as a waterproof layer.

In the thermal transfer image-receiving paper of the present invention, the thickness of the fibrous layer is relatively smaller than the thickness of the base paper or of the base paper combined with the foamed plastic film layer thereby preventing the curling caused by absorption and desorption of moisture by the fibrous paper layer itself.

BRIEF DESCRIPTION OF THE DRAWING

FIG. 1 is a sectional view of one example of the thermal transfer image-receiving paper of the present invention.

DETAILED DESCRIPTION OF THE PREFERRED EMBODIMENT

Hereinafter, the mode for carrying out the present invention is described by reference to the drawing. FIG. 1 is a sectional view of one example of the thermal transfer image-receiving paper of the present invention.

In FIG. 1, 1 is a base paper, 2 is a foamed plastic film layer provided on the surface of the base paper 1, and 3 is an image-receiving layer provided on the foamed plastic film layer 2. An interlayer (not shown) such as a plastic film, a fibrous paper, or an undercoat layer with the aim of enhancing adhesion or changing a color tone can be arranged between the foamed plastic film layer 2 and the image-receiving layer 3. In the present invention, techniques such as lamination and coating known in the art are used to provide the base paper 1 thereon with the foamed plastic film layer 2 or to provide the foamed plastic film layer 2 thereon with the image-receiving layer 3.

4 is a fibrous paper layer provided on that side of the base paper 1 on which the image-receiving layer 3 is not provided, and the base paper is provided via waterproof layer 5 with the fibrous paper layer.

From a viewpoint of the feeling of the image-receiving paper or of preventing troubles during transportation, the paper used in the base paper 1 is preferably a rigid one required for the image-receiving paper, and examples of such papers are those generally commercially available, such as cast coated paper, art coated paper, painted paper, slick paper, chemical fibrous paper etc., preferably those with smooth surfaces, such as cast coated paper, art coated paper etc. Further, the base paper 1 can make use of plastic film or foamed plastic film besides those enumerated above, and fibrous papers represented by cellulose are preferably used. The weight of the base material 1 is 70 to 160 g/m$^2$, preferably 90 to 140 g/m$^2$.

Then, the foamed plastic film layer 2 makes use of a foamed plastic film prepared by drawing a synthetic resin such as polyethylene terephthalate, polypropylene etc. to which fine inorganic powder of calcium carbonate, titanium oxide or the like has been added to render the film porous during manufacturing. In the present invention, the foamed plastic film refers to any plastic film containing a large number of bubbles or voids in the layer thereof, regardless of its production process. For example, foamed plastic films foamed by a foaming agent or foamed plastic films foamed by mixing them with foaming beads can be used in addition to those described above, and from a viewpoint of costs and flatness, those prepared by drawing are preferable. The thickness of the foamed plastic film is 20 to 125 $\mu$m, preferably 25 to 80 $\mu$m.

The image-receiving layer 3 provided on the foamed plastic film layer 2 is composed of, for example, a binder resin, a dispersant, a plasticizer and a pigment, and any surface-layer forming techniques known in the art, such as wet process and dry process can be used to provide it on the foamed plastic film layer 2. The thermal transfer system includes a thermal sublimation system for thermally sublimating and spreading ink and a thermal melting system for thermally melting and transferring ink-containing wax, and characteristics required of the surface of the image-receiving layer vary depending on the case, and any of the above systems can be used insofar as the image-receiving layer 3 can be provided in a flat form on the foamed plastic film layer 2, but higher effects are brought about when it is used the thermal sublimation type whose problem is heat curing during thermal transfer.

The waterproof layer 5 can make use of a copolymer resin film or a resin layer of polyethylene, polypropylene, polyvinyl chloride, polyethylene terephthalate, polystyrene, polycarbonate, ethylene-vinyl chloride etc. The thickness of the waterproof layer 5 is 1 to 100 $\mu$m, preferably 5 to 80 $\mu$m.

The fibrous paper layer 4 exhibits functions such as writing properties possessed by the fibrous paper itself and frictional properties thereof on a roll, and the fibrous paper as the fibrous paper layer 4 makes use of slick paper, middle-grade paper, rough paper, vellum, cast coated paper, art paper, minutely coated paper, thin leaf paper, chemical pulp paper etc. In addition to these papers, it is possible to use any papers having writing properties or typing and printing properties capable of ink jet printing, as well as fancy papers such as crepe paper etc. for imparting functions adapted to the use, or colored papers or printed papers, or papers printed so as to be usable as post cards (those having the position of a stamp or a column for zip cord previously printed thereon).

Though not shown, the non-adhering side of the fibrous paper layer 4 can be subjected to treatments such as application of a lubricating agent, application of an antistatic agent, attachment or application of an UV blocker or an antioxidant for improving handling such as papermaking, protection of a print or for improving appearance, or addition or application of a sizing agent etc. for preventing oozing.

Hereinafter, the method of providing the base paper 1 with the waterproof layer 5 and the fibrous paper layer 4 is described.

(1) A method of laminating a plastic film as the waterproof layer 5 onto the base paper 1 and then laminating a fibrous paper as the fibrous paper layer 4.

The lamination method is a film or paper lamination system known in the art, such as dry lamination and extrusion lamination.

(2) A method of laminating a plastic film as the waterproof layer 5 and a fibrous paper as the fibrous paper layer 4 and then laminating the resulting composite onto the base paper 1.

The lamination method is the same as in item (1) above.

In this method, commercial polylaminated papers such as those used in packaging of confectionery or water-resistant packaging papers can be used inexpensively.

(3) A method of directly laminating the base layer 1 and a fibrous paper as the fibrous paper layer 4 in an extrusion lamination system.

This method can be accomplished in one step and does not require a previously formed film to achieve a significant reduction in costs.

In this method, an adhesive layer in the joint portion between the base paper 1 and the fibrous paper layer 4 serves as the waterproof layer.

(4) A method of applying a molten resin in a roll coating system and directly laminating the base paper 1 onto a fibrous paper as the fibrous paper layer 4.

This method is known as hot-melt adhesion.

(5) A method of laminating the base paper 1 and a fibrous paper as the fibrous paper layer 4 in a dry lamination system.

Due to the additional steps of impregnating the paper with a low viscous resin or of drying a solvent, this method requires higher costs than those of the methods described above.

In the present invention, any lamination method described above can be selected as necessary, but the methods (3) and (4) are particularly effective because costs can be reduced.

The present invention is as described above, and since the thermal transfer image-receiving paper of the present invention possesses the fibrous paper layer on the side on which the image-receiving layer is not provided, the back of the image-receiving paper can be effectively utilized by virtue of the advantageous action of the fibrous paper. For example, since the back of the image-receiving paper is excellent in writing properties, it can be written with a pencil, a ballpoint pen, and in particular, it is superior in writing properties with a writing brush and an aqueous pen. Further, it is superior in printing properties and can be printed particularly with an ink for general papers. Further, it can be easily printed or typed with an ink jet printer used widely at present, and used in post-card printing for use as a post card.

Further, the thermal transfer image-receiving paper of the present invention is excellent in mechanical printing properties, and a sensor mark etc. for positioning in printing can be easily printed thereon, and further its transfer in a printer is excellent so there is also the effect of maintaining the qualities of a print by thermal transfer at the same level as in the prior art.

Moreover, the intermediate waterproof layer in the thermal image-receiving paper of the present invention can prevent the curling caused by absorption and desorption of moisture by the base paper, and even when the fibrous paper layer absorbs moisture, there does not occur practically problematic curling.

Furthermore, because in the thermal image-receiving paper of the present invention, the base paper can be easily provided by e.g. lamination with a fibrous paper as the fibrous paper layer on the side on which the image-receiving layer is not provided, the thermal image-receiving paper of the invention can be produced more easily at lower costs than by conferring writing properties and printing properties on a conventional waterproof layer or a resin layer provided for preventing curling.

Hereinafter, the Examples of the thermal transfer image-receiving paper of the present invention are described.

EXAMPLES

The following composition was sufficiently stirred, dispersed and applied by a roll coater onto a foamed film to form an image-receiving layer of 10 μm in thickness after drying and used in common in the Examples below.

| | |
|---|---|
| Water dispersible polyester resin (Toyobo Co., Ltd.: Bironal MD1200) | 100 parts by weight |
| Silica (Nippon Aerozil Co., Ltd.: Aerozil 200) | 30 parts by weight |
| Water | 50 parts by weight |
| Urea-based filler | 10 parts by weight |

(Nippon Kasei Chemical Co., Ltd.: organic filler IM-3)

Example 1

50 μm foamed polyester film was laminated onto an art face of a 127.9 g/m$^2$ semi-art paper as the base paper by extrusion lamination using polyethylene as a molten polymer. Further, 30 g/m$^2$ thin leaf paper was laminated onto the other side of the base paper under the same conditions, and the foamed polyester film was provided thereon with the image-receiving layer described above whereby the first example of the image-receiving paper of the present invention was obtained. The thickness of the polyethylene layer on both sides was 20 μm.

Example 2

50 μm foamed polyester film was laminated onto one side of a 127.9 g/m$^2$ double-sided art paper as the base paper in the same manner as in Example 1. Further, 40 g/m$^2$ minutely coated paper was laminated onto the other side of the base paper in the same manner as in Example 1, and the foamed polyester film was provided thereon with the image-receiving layer described above whereby the second example of the image-receiving paper of the present invention was obtained. The thickness of the polyethylene layer on both sides was 25 μm.

Example 3

50 μm foamed polyester film was laminated onto the art face side of a 104.7 g/m$^2$ semi-art paper as the base paper. Further, 25 μm transparent PET (polytetraethylene terephthalate) was laminated onto the other side of the base paper in the same manner as in Example 1, and further 30 g/m$^2$ thin leaf paper was laminated thereon by dry lamination using ethylene-vinyl acetate resin as an adhesive material. Finally, the foamed polyester film was provided thereon with the image-receiving layer described above whereby the third example of the image-receiving paper of the present invention was obtained.

Example 4

50 μm foamed polypropylene film was laminated onto the art face side of a 127.9 g/m$^2$ semi-art paper as the base paper in the same manner as in Example 1, and a polyethylene laminated paper having 20 μm of 30 g/m$^2$ thin leaf paper laminated on one side of a polyethylene film was laminated onto the other side of the base paper in dry lamination in the same manner as in Example 3 such that the thin leaf paper was outside. The foamed polyester film was provided thereon with the image-receiving layer described above whereby the fourth example of the image-receiving paper of the present invention was obtained.

Example 5

20 μm foamed polypropylene film was laminated onto the art face side of a 157 g/m$^2$ semi-art paper as the base paper in the same manner as in Example 1, and 30 g/m$^2$ thin leaf paper (dry weight: 30 g) was laminated onto the other side of the base paper by hot melting with a roll coater using an ethylene-vinyl acetate resin as an adhesive material. The foamed polypropylene film was provided thereon with the image-receiving layer described above whereby the fifth example of the image-receiving paper of the present invention was obtained.

Example 6

In laminating the transparent PET film onto the base material in Example 3, one side of the PET film was subjected previously to hot melt treatment in place of melt extrusion lamination and then adhesion-laminated by passing it through a heat roll whereby the sixth example of the present invention was obtained.

Comparative Example 1

In laminating the 30 g/m$^2$ thin leaf paper in Example 1, an ethylene-vinyl acetate resin (dry weight: 5 g) was used as an adhesive layer in dry lamination in place of melt extrusion whereby an image-receiving paper was obtained.

Comparative Example 2

In Example 1, the 30 g/m$^2$ minutely coated paper was not laminated, and only polyethylene as an adhesive material was laminated in melt extrusion onto the art paper face on the opposite side to the image-receiving layer whereby an image-receiving paper was obtained.

Comparative Example 3

An image-receiving paper was obtained without laminating the 30 g/m$^2$ thin leaf paper onto the transparent polyester film in Example 3.

Comparative Example 4

An image-receiving paper was obtained by laminating a 64 g/m$^2$minutely coated paper in place of the 30 g/m$^2$minutely coated paper in Example 1.

Curling of the papers in Examples 1 to 6 and Comparative Examples 1 to 4 after left for 72 hours, as well as the writing properties of the back of each paper with a pencil and an aqueous pen, was measured and evaluated according to 3 criteria (1) to (3) shown below Table 1, and the results are shown in Table 1.

TABLE 1

| Item | Curling 23° C. 20% RH | Curling 23° C. 65% RH | Curling 23° C. 80% RH | Writing properties | Trans-portation |
|---|---|---|---|---|---|
| Example 1 | ○ | ○ | ○ | ○ | ○ |
| Example 2 | ○ | ○ | Δ | ○ | ○ |
| Example 3 | ○ | ○ | Δ | ○ | ○ |
| Example 4 | ○ | ○ | ○ | ○ | ○ |
| Example 5 | ○ | ○ | ○ | ○ | ○ |
| Example 6 | Δ | ○ | Δ | ○ | ○ |
| Comparative Example 1 | x | x | x | ○ | Δ |
| Comparative Example 2 | ○ | ○ | ○ | x | Δ |
| Comparative Example 3 | ○ | ○ | Δ | x | Δ |
| Comparative Example 4 | x | Δ | x | ○ | Δ |

(1) In curling on A4-sized paper, ○ indicates no or little curling; Δ, slight curling but not practically problematic; ×, significant curling and practically problematic.

(2) In writing properties, ○ is good and × is poor.

(3) In transportation, ○ is good; Δ, poor depending on conditions such as humidity; and ×, poor.

What is claimed is:

1. A thermal transfer image-receiving paper comprises a base paper provided thereon with a foamed plastic film layer, said plastic film layer being provided thereon with an image-receiving layer while said base paper being provided with a fibrous paper layer via a waterproof layer on the side on which the image-receiving layer is not provided.

2. A thermal transfer image-receiving paper according to claim 1, wherein the waterproof layer has been provided by extrusion lamination of a molten polymer.

3. A thermal transfer image-receiving paper according to claim 1, wherein the waterproof layer has been provided by roll coating of a resin.

4. A thermal transfer image-receiving paper according to claim 1, wherein the fibrous paper layer has been provided by melt extrusion lamination without using a previously formed film, on that side of the base paper on which the image-receiving layer is not provided.

* * * * *